US005797280A

United States Patent [19]

Lee

[11] Patent Number: 5,797,280

[45] Date of Patent: Aug. 25, 1998

[54] REFRIGERATOR WITH AN EXTERNAL AIR INVASION PREVENTION APPARATUS

[75] Inventor: Kang-Sun Lee, Seoul, Rep. of Korea

[73] Assignee: Daewoo Electronics Co., Ltd., Seoul, Rep. of Korea

[21] Appl. No.: 685,922

[22] Filed: Jul. 22, 1996

[30] Foreign Application Priority Data

Jul. 20, 1995 [KR] Rep. of Korea ..... 95-21426

[51] Int. Cl.[6] ..... F25D 17/04

[52] U.S. Cl. ..... 62/408

[58] Field of Search ..... 62/404, 407, 408, 62/405, 441, 186, 187, 188

[56] References Cited

U.S. PATENT DOCUMENTS

| | | | |
|---|---|---|---|
| 2,150,064 | 3/1939 | John et al. | 62/407 |
| 2,633,003 | 3/1953 | Jordan | 62/408 |
| 4,379,391 | 4/1983 | Rhee | 62/408 |
| 5,111,664 | 5/1992 | Yang | 62/3.62 |
| 5,214,936 | 6/1993 | Lim et al. | 62/407 |

*Primary Examiner*—William Doerrler

*Attorney, Agent, or Firm*—Beveridge, DeGrandi, Weilacher & Young LLP

[57] ABSTRACT

A refrigerator with an external air invasion prevention apparatus is disclosed. The refrigerator has a return duct, a duct cover, and an external air invasion prevention apparatus. The return duct has an air inlet portion and is formed in a wall separating a freezing room and a refrigerating room, and provides a passageway to circulate cooled air in the refrigerator. The duct cover has a plurality of air inlet holes and covers the air inlet portion. The external air invasion prevention apparatus closes and opens the plurality of air inlet holes according to opening and closing of a door of the refrigerator. External air which is air outside the refrigerator is prevented from flowing into the return duct. Further, the porous material is provided to absorb moisture in the cooled air when a moist cooled air is circulated through the return duct. Frost on the evaporator can be reduced due to the absorption of the moisture of the circulated cooled air.

34 Claims, 4 Drawing Sheets

FIG. 3
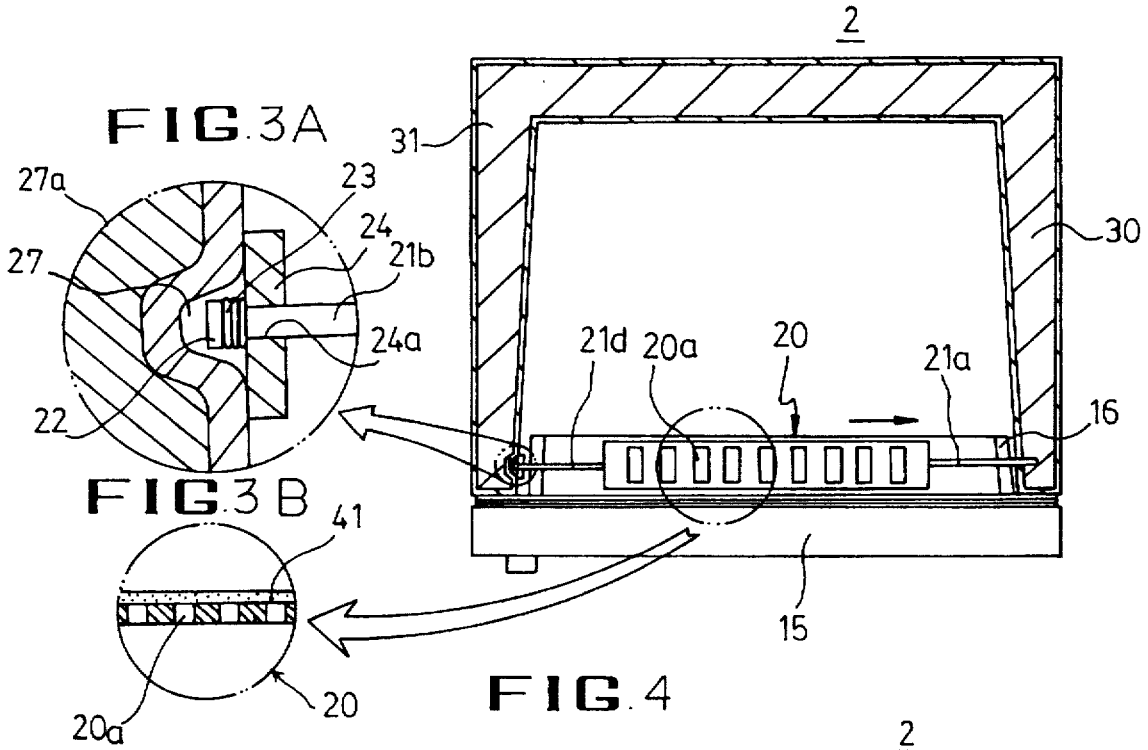
FIG. 3A
FIG. 3B
FIG. 4
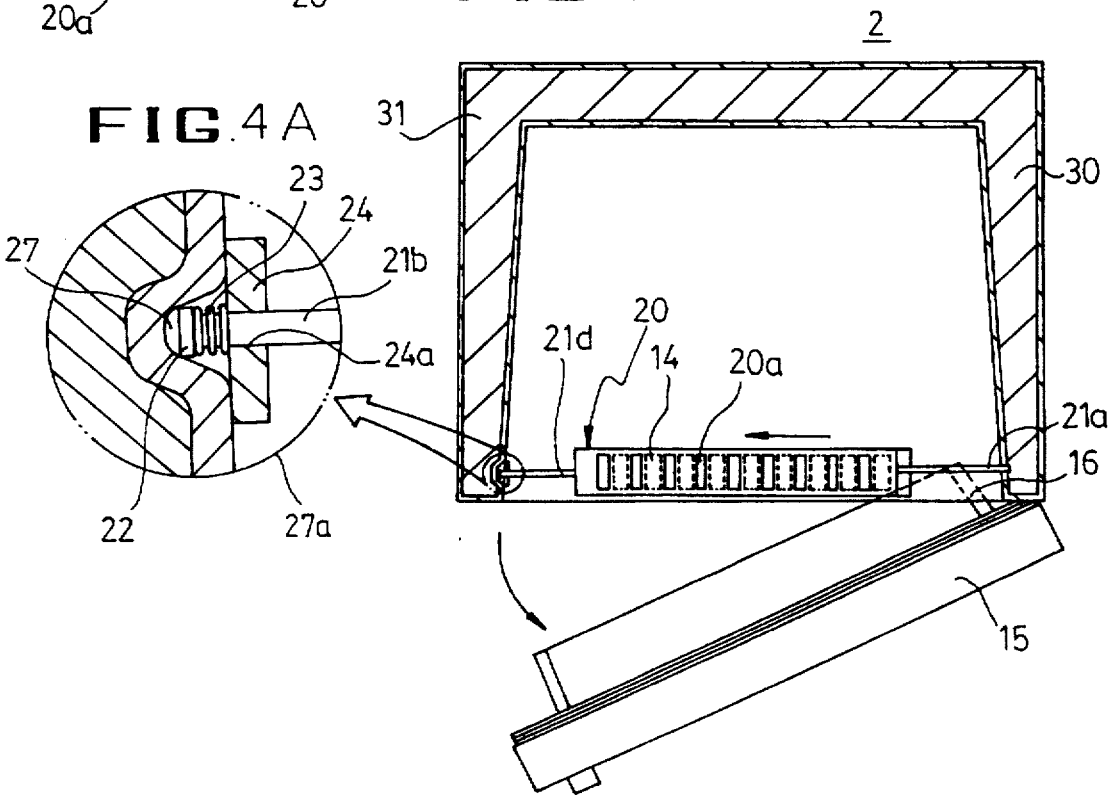
FIG. 4A

REFRIGERATOR WITH AN EXTERNAL AIR INVASION PREVENTION APPARATUS

BACKGROUND OF THE INVENTION

1. Field of the Invention

The present invention relates to a refrigerator, and more particularly to a refrigerator with an external air invasion prevention apparatus.

2. Prior Art

FIG. 1 is a view for showing external air invasion of a conventional refrigerator by the flow of air when a door of the conventional refrigerator is open. As shown in FIG. 1, a refrigerator 1 is, in general, equipped with a freezing room F and a refrigerating room R. Freezing room F and refrigerating room R is separated by a wall 10. Refrigerator 1 is provided with a return duct 11 and an evaporator 17. Return duct 11 is a air-circulating passageway for circulating cooled air in refrigerator 1 through evaporator 17. The cooled air is the air within refrigerator 1. Return duct 11 is formed inside wall 10. Return duct 11 has air inlet portions 2*a* and 2*b*. The cooled air in refrigerator 1 flows into air inlet portions 2*a* and 2*b*. A duct cover 12 is mounted to cover air inlet portions 2*a* and 2*b*. Duct cover 12 has a plurality of sucking holes 14 arranged in a certain interval therebetween. The cooled air flows into return duct 11 through the plurality of air inlet holes 14. Evaporator 17 is mounted at a rear side of freezing room F. The cooled air which has flowed into return duct 11 is exhausted toward evaporator 17.

In such structure of refrigerator 1, when a door 15 of refrigerator 1 is opened, external air invades return duct 11 through the plurality of sucking holes 14. The external air is the air outside refrigerator 1. The invaded external air causes evaporator 17 to be frosted thereon, thereby decreasing the effectiveness of refrigerator 1.

SUMMARY OF THE INVENTION

It is an object of the present invention to provide a refrigerator with an external air invasion prevention apparatus capable of preventing external air from flowing into a return duct when a refrigerator door is opened.

In order to achieve the above object, a refrigerator with an external air invasion prevention apparatus according to the present invention comprises a return duct, a duct cover and an external air invasion prevention apparatus. The return duct is formed in the wall separating a freezing room and a refrigerating room so as to provide a passageway for circulating cooled air in the refrigerator and has an air inlet portion communicating the freezing room and the refrigerating room. The duct cover is provided at the air inlet portion and has a plurality of air inlet holes. The external air invasion prevention apparatus opens or closes the plurality of air inlet holes according to closing or opening of a refrigerator door. The external air invasion prevention apparatus includes a link part, a rod part, a rod-receiving part and a shutter part. The link part is installed at the side wall with which the door of the refrigerator is engaged, and the link part moves in left and right directions according to closing and opening of the door of the refrigerator. The rod part moves in left and right directions according to the left and right movements of the link part. The rod-receiving part is installed at another side wall opposite to the side wall. The rod-receiving part movably receives one end portion of the link part. The center portion of one side of the shutter part is fixed to one end of the link part and the center portion of another side of the shutter part is fixed to the so that the shutter part is disposed between the link part and the rod part. The another side of the shutter part is the side opposite to the one side. The shutter part covers the duct cover so as to open and close the plurality of air inlet holes. That is, the shutter part moves in the left and right directions according to the left and right movements of the link part, so that the shutter part opens and closes the plurality of air inlet holes. A porous material may cover the upper surface of the shutter part. According to the above structure, air outside a refrigerator can be prevented from flowing into or invading the refrigerator as a refrigerator door is opened. Further, the porous material absorbs moisture in the cooled air when a moist cooled air is circulated through the return duct, and the porous material releases moisture into the circulated cooled air when the cooled air becomes dry. Therefore, the porous material keeps the moisture in the circulated cooled air constant. Furthermore, frost on the evaporator can be reduced due to the absorption of the moisture of the circulated cooled air.

BRIEF DESCRIPTION OF THE DRAWINGS

FIG. 3 is a view for showing the position of the shutter part of FIG. 2 when a door of the refrigerator is closed;

FIG. 3A is a view for showing the state of the restoring spring of FIG. 2 when the door of the refrigerator is closed;

FIG. 3B is an enlarged view for schematically showing a portion of a shutter part of FIG. 3;

FIG. 4 is a view for showing the position of the shutter part of FIG. 2 when the door of the refrigerator is opened;

FIG. 4A is a view for showing the state of the restoring spring of FIG. 2 when the door of the refrigerator is opened;

DETAILED DESCRIPTION OF THE INVENTION

Figure 1:
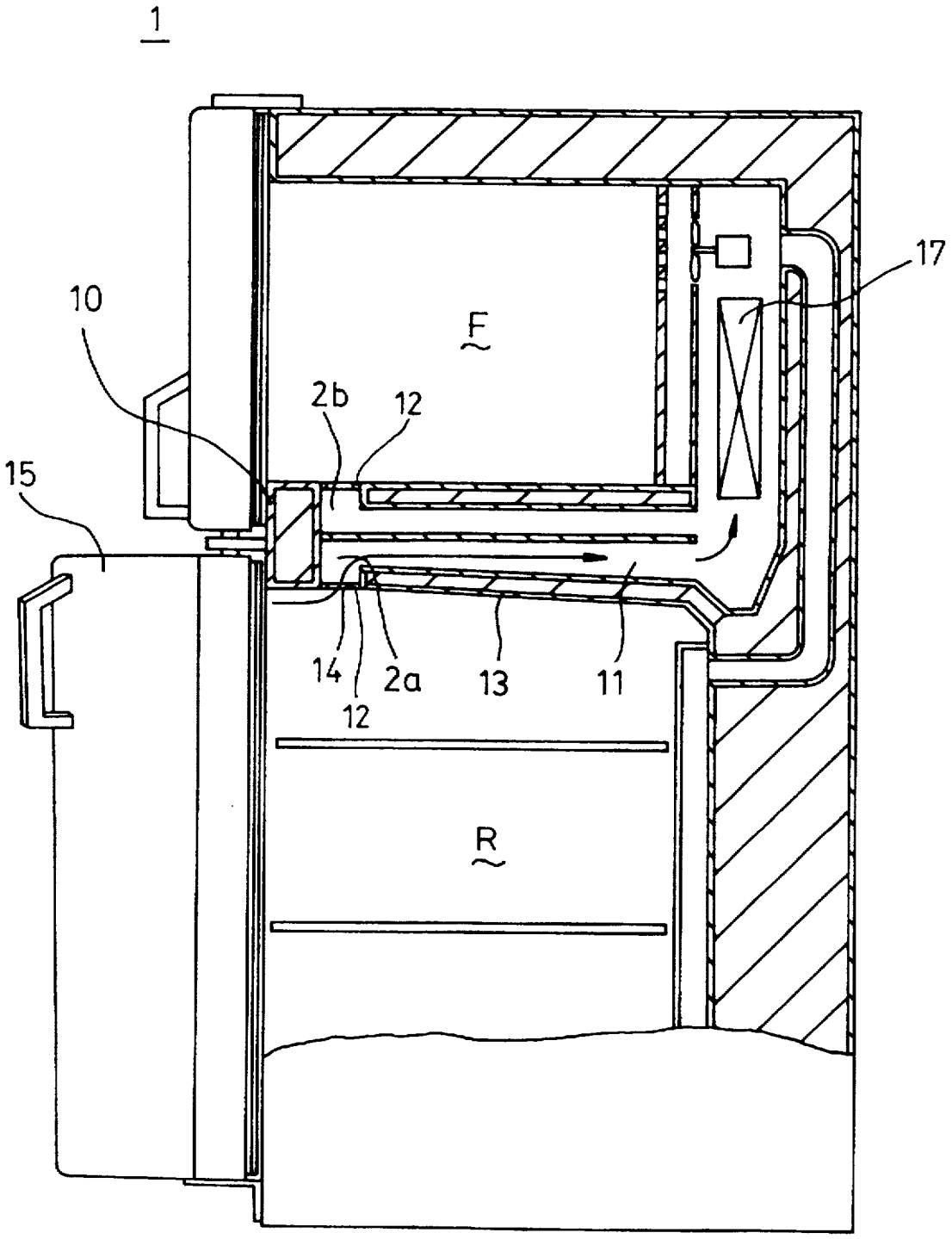
FIG. 1 is a view for showing external air invasion of a conventional refrigerator by the flow of air when a door of the conventional refrigerator is opened.
Figure 2:
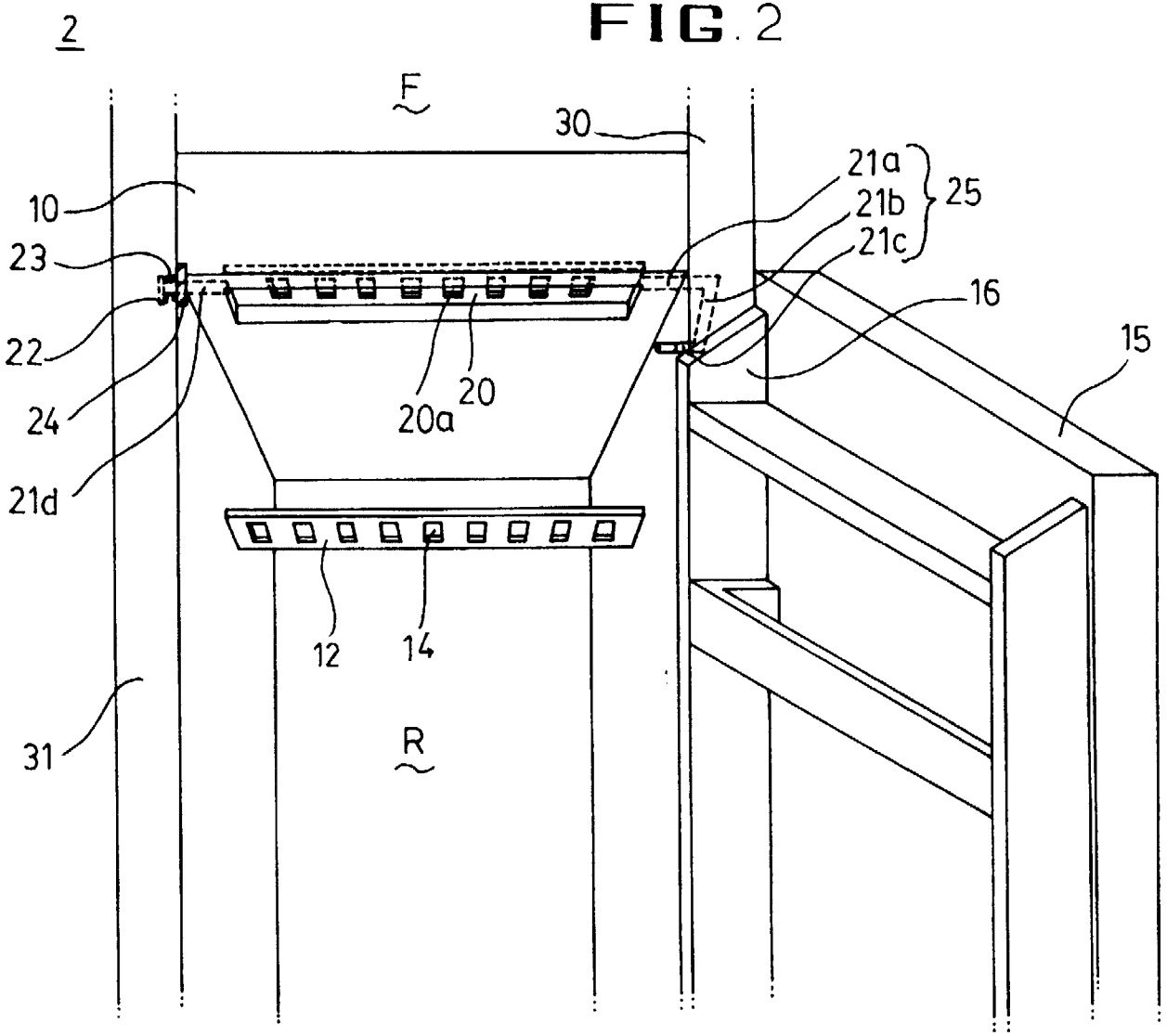
FIG. 2 is a perspective view of a refrigerator with an external air invasion prevention apparatus according to the first embodiment of the present invention.

FIG. 2 is a perspective view of a refrigerator with an external air invasion prevention apparatus according to the first embodiment of the present invention, and FIG. 3 is a view for showing the position of the shutter part of FIG. 2 when a door of the refrigerator is closed. As shown in FIGS. 2 and 3, the external air invasion prevention apparatus according to the first embodiment of the present invention comprises a shutter part 20, a spring seat 22, a restoring spring 23, a groove cover 24, a rod-receiving groove part 27*a*, a rod part 21*d*, and a link part 25. A reference numeral 2 denotes a refrigerator. Link part 25 moves in left and right directions according to the closing and opening of a door 15 of refrigerator 2. Link part 25 is formed in a doubly bent fashion. That is, link part 25 has a first rod portion 21*a*, a second rod portion 21*b*, and a third rod portion 21*c*. Second rod portion 21*b* is bent in a certain angle with respect to first rod portion 21*a*, and third rod portion 21*c* is bent in a certain angle with respect to second rod portion 21*b* so as to be in parallel with first rod portion 21*a*. Link part 25 is engaged with a side wall 30 on which door 15 is mounted. One end of first rod portion 21*a* is fixed to the center portion of one side of shutter part 20, and the other end of first rod portion 21*a* is inserted into side wall 30. Second rod portion 21*b* is mounted in side wall 30. One end of third rod portion 21*c* protrudes outside side wall 20. Second rod portion 21*b* connects the other end portion of first rod portion 21*a* with the other end portion of third rod portion 21*c* inside side wall 30. When door 15 is closed, the protruded one end portion of third rod portion 21*c* is pushed into side wall 30 by one side of door 15. One end portion of rod part 21*d* is fixed to the center portion of another side of shutter part 20. The another side is a side opposite to the one side of shutter part 20. The other end portion of rod part 21*d* is movably fixed to a side wall 31 of refrigerator 2. Side wall 31 is a wall opposite to side wall 30. As shown in FIG. 3, rod-receiving groove part 27*a* is formed in side wall 31 so as to receive the other end portion of rod part 21*d*. Rod-receiving groove part 27*a* has a rod-receiving groove 27, a groove cover 24, and a restoring spring 23. Rod-receiving groove 27 is formed in a conical fashion. Rod-receiving groove 27 is covered by groove cover 24 which is fixed on side wall 31. Groove cover 24 has an opening at its center portion. The other end portion of rod part 21*d* is received in rod-receiving groove 27 through the opening of groove cover 24. A spring seat 22 is formed on the one end portion of rod part 21*d*. Restoring spring 23 is inserted into the one end of rod part 21*d* and positioned between spring seat 22 and groove cover 24. Restoring spring 23 is supported by spring seat 22 which is formed in a disc-shaped fashion. The diameter of spring seat 22 is larger than that of the one end portion of rod part 21*d*. Accordingly, opening and closing of door 15 of refrigerator 2 cause link part 25 to move in the left and right directions, so that shutter part 20 and rod part 21*d* move in the left and right directions. Shutter part 20 is positioned to cover a duct cover 12 which has a plurality of air inlet holes 14 arranged in a row and in a certain interval therebetween. As mentioned above, shutter part 20 moves in the left and right directions so as to close and open the plurality of air inlet holes 14. Shutter part 20 has a plurality of shutter holes 20*a* arranged in the same row and in the same interval therebetween as in duct cover 12. Therefore, each of the plurality of shutter holes 20*a* corresponds with each of the plurality of air inlet holes 14 of duct cover 12. When shutter part 20 moves in the left and right directions, the plurality of shutter holes 20*a* opens and closes the plurality of air inlet holes 14. Further, as shown in FIG. 3B, a plate-shaped porous material 41 is attached on the upper surface of shutter part 20. Plate-shaped porous material 41 may be a fibrous material.

Operations of the external air invasion prevention apparatus of a refrigerator according to the first embodiment of the present invention will be described in detail below.

FIG. 3 is a view for showing the position of shutter part 20 of FIG. 2 when door 15 of refrigerator 2 is closed, and FIG. 4 is a view for showing the position of shutter part 20 of FIG. 2 when door 15 of refrigerator 2 is opened. As shown in FIGS. 3 and 4, as door 15 of refrigerator 2 is being closed, one side 16 of door 15 is pushing the protruded one end portion of third rod portion 21*c* inward side wall 30. Accordingly, when door 15 of refrigerator 2 is completely closed, the protruded one end portion of third rod portion 21*c* is completely inserted in side wall 30 of refrigerator 2. As the protruded one end portion of third rod portion 21*c* is being inserted, as shown in FIG. 3, shutter part 20 is being moved in the left direction. As shutter part 20 is being moved in the left direction, each of the plurality of shutter holes 20*a* starts to correspond with each of the plurality of air inlet holes 14. When there is a complete correspondance of holes 20*a* and 14, return duct 11 allows only the cooled air in refrigerator 2 to be circulated since door 15 is completely closed. At this time, as shown in FIG. 3A, restoring spring 23 has a restoring force therein since it is compressed.

As door 15 of refrigerator 2 is being opened, the inserted one end portion of third rod portion 21*c* is being protruded from the inside of side wall 30, causing shutter part 20 to move in the right direction. When door 15 is completely opened, as shown in FIG. 2, the inserted one end portion of third rod portion 21*c* is completely protruded outside side wall 30, so that the plurality of air inlet holes 14 is blocked by the plurality of shutter holes 20*a* as shown in FIG. 4. Therefore, external air which is air outside refrigerator 2 is prevented from flowing into return duct 11. At this time, restoring spring 23 is loosened as shown in FIG. 4A.

Figure 5:
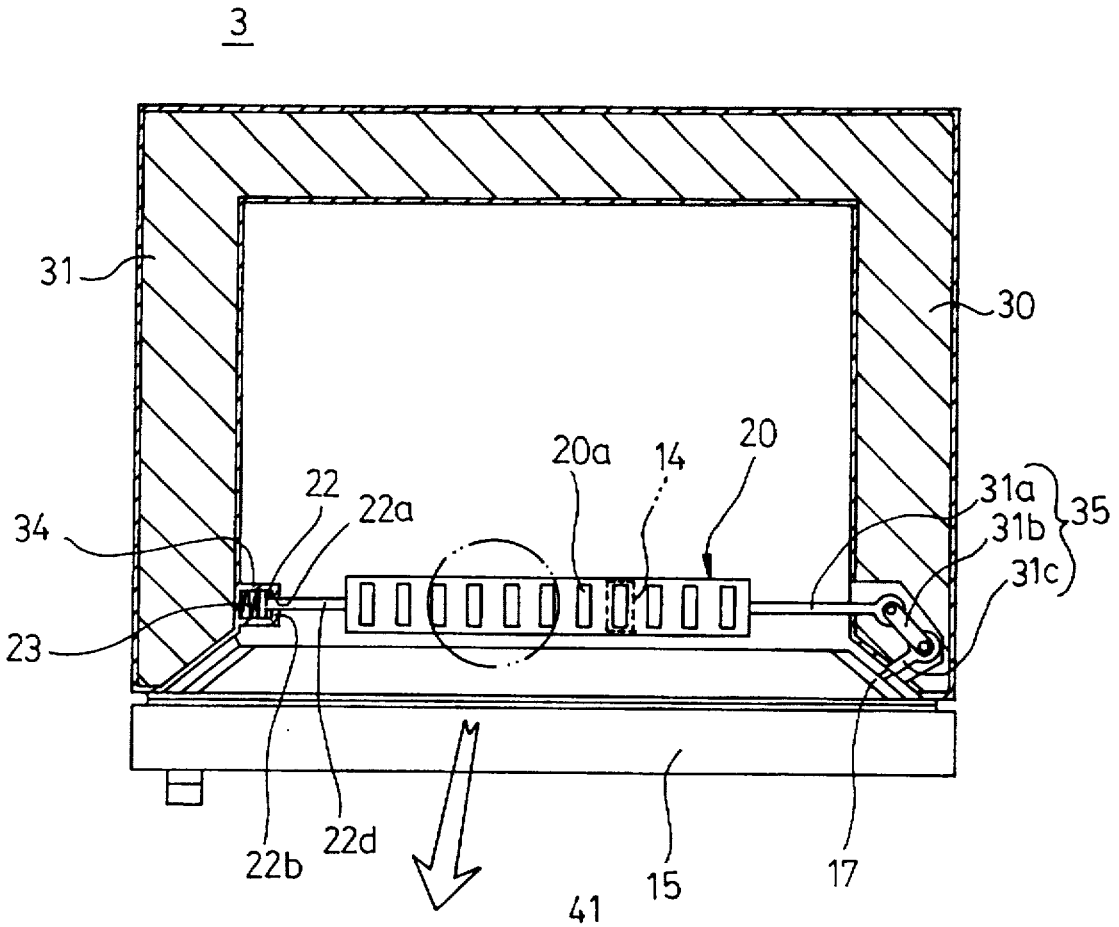
FIG. 5 is a perspective view of a refrigerator with another external air invasion prevention apparatus according to the second embodiment of the present invention.

FIG. 5 is a perspective view of a refrigerator with another external air invasion prevention apparatus according to the second embodiment of the present invention. The parts shown in FIGS. 2 and 4 are denoted by the same reference numerals in FIG. 5. As shown in FIG. 5, a refrigerator with an external air invasion prevention apparatus according to the second embodiment of the present invention comprises a shutter part 20, a spring seat 22, a restoring spring 23, a rod part 21*d*, a protrusion 34, and a link part 35. Reference numeral 3 denotes a refrigerator.

Link part 35 moves in the left and right directions according to closing and opening of door 15 of a refrigerator 3. Link part 35 has a first rod portion 31*a*, a second rod portion 31*b*, and a third rod portion 31*c*. Second rod portion 31*b* is rotatably connected with first rod portion 31*a* and second rod portion 31*c*. Link part 35 is movably engaged with side wall 30 on which door 15 is mounted. That is, one end portion of first rod portion 31*a* is fixed to the center portion of one side of shutter part 20, and the other end portion of first rod portion 31*a* has a hole (not shown but fully perceivable from FIG. 5). The other end portion of first rod portion 31*a* is movably inserted into side wall 30. One end of third rod portion 31*c* is movably inserted into side wall 30 and has a hole (not shown but fully perceivable from FIG. 5). Second rod portion 31*b* is mounted in side wall 30 and rotatably connects the other end portion of first rod portion 31*a* with the one end portion of third rod portion 31*c*. The other end portion of third rod portion 31*c* is protruded outside side wall 30 of refrigerator 3.

Figure 5A:
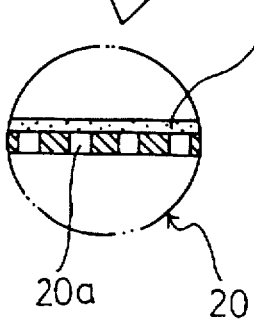
FIG. 5A is an enlarged view for schematically showing a portion of a shutter part of FIG. 5.

When door 15 is being closed, the protruded other end portion of third rod portion 31*c* is being inserted into side wall 30 by one side of door 15, as understood when considered together with FIG. 4. One end portion of rod part 22*d* is fixed to the center portion of another side of shutter part 20. The another side of shutter part 20 is the side opposite to the one side of shutter part 20. The other end portion of rod part 22*d* is mounted on a side wall 31 which is the wall opposite to side wall 30. As shown in FIG. 5, side wall 31 is provided with a protrusion 34 to receive the other end portion of rod part 22*d*. Protrusion 34 is formed in a round bar shape having a hollow portion at the center thereof. The hollow portion is covered by a cover 22*b* having an insertion hold 22*a*. The other end portion of rod part 22*d* is movably inserted into protrusion 34 through insertion hole 22*a* of cover 22*b*. The other end portion of rod part 22*d* is provided with a spring seat 22. Restoring spring 23 is positioned between spring seat 22 and the bottom of the hollow portion. Spring seat 22 is supported by restoring spring 23. Therefore, when link part 35 is moved in the left and right directions according to closing and opening of door 15 of refrigerator 3, shutter part 20 and rod part 22*d* are moved in the left and right directions. As in the first embodiment, shutter part 20 is positioned to cover a duct cover 12 which has a plurality of air inlet holes 14 arranged in a row and in a certain interval therebetween. As mentioned above, shutter part 20 moves in the left and right directions so as to close and open the plurality of air inlet holes 14. Shutter part 20 has a plurality of shutter holes 20*a* arranged in the same row and in the same interval therebetween as in duct cover 12. Therefore, each of the plurality of shutter holes 20*a* corresponds with each of the plurality of air inlet holes 14 of duct cover 12. When shutter part 20 moves in the left and right directions, the plurality of shutter holes 20*a* opens and closes the plurality of air inlet holes 14. Further, as shown in FIG. 5A, a plate-shaped porous material 41 is attached on the upper surface of shutter part 20. Plate-shaped porous material 41 may be a fibrous material.

Operations of the external air invasion prevention apparatus of a refrigerator according to the second embodiment of the present invention will be described in detail below.

FIG. 5 shows the position of shutter part 20 when door 15 is closed. As shown in FIG. 5, a door 15 of refrigerator 3 is being closed, one side 17 of door 15 is pushing the protruded other end portion of third rod portion 31*c* inward side wall 30. Accordingly, when door 15 of refrigerator 3 is completely closed, the protruded other end portion of third rod portion 31*c* is completely inserted in side wall 30 of refrigerator 3. As the protruded other end portion of third rod portion 31*c* is being inserted, as shown in FIG. 5, shutter part 20 is being moved in the left direction. As shutter part 20 is being moved in the left direction, each of the plurality of shutter holes 20*a* starts to correspond with each of the plurality of air inlet holes 14. When there is a complete correspondance of holes 20*a* and 14, return duct 11, as referring to FIG. 2 together, allows only the cooled air in refrigerator 3 to be circulated since door 15 is completely closed. At this time, as shown in FIG. 5, restoring spring 23 has a restoring force therein since it is compressed.

As door 15 of refrigerator 3 is being opened, the inserted other end portion of third rod portion 31*c* is being protruded from the inside of side wall 30, causing shutter part 20 to move in the right direction. When door 15 is completely opened, as referring to FIG. 2 together, the inserted other end portion of third rod portion 31*c* is completely protruded outside side wall 30, so that the plurality of air inlet holes 14 is blocked by the plurality of shutter holes 20*a* as referring to FIG. 4 together. Therefore, external air which is air outside refrigerator 3 is prevented from flowing into return duct 11. At this time, restoring spring 23 is loosened as referring to FIG. 4A together.

Further, the porous material absorbs moisture in the cooled air when a moist cooled air is circulated through the return duct, and the porous material releases moisture into the circulated cooled air when the cooled air becomes dry. Therefore, the porous material keeps the moisture in the circulated cooled air constant. Therefore, frost on the evaporator can be reduced due to the absorption of the moisture of the circulated cooled air.

What is claimed is:

1. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion;

an external air invasion prevention apparatus for closing and opening the plurality of air inlet holes according to opening and closing of a door of the refrigerator;

a link part movably engaged with a first side wall on which the door is mounted, and moving in the left and right directions according to the closing and opening of the door;

a rod part moving in the left and right directions according to the left and right directions of the link part;

a rod-receiving groove part formed on a second side wall and movably receiving one end portion of the rod part, the second side wall being a side wall opposite to the first side wall; and a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part.

2. The refrigerator as claimed in claim 1, wherein the link part is formed in a doubly bent fashion.

3. The refrigerator as claimed in claim 1, wherein the link part comprises:

a first rod portion having two end portions, one end portion being fixed to the center portion of the first side of the shutter part and the other end portion being movably inserted into the second side wall;

a second rod portion bent at the other end portion of the first rod portion in a certain angle with respect to the first rod portion, and mounted in the first side wall; and a third rod portion bent in a certain angle with respect to the second rod portion so as to be in parallel with the first rod portion, and protruded outward the first side wall so as to be contacted with the door when closing and opening the door.

4. The refrigerator as claimed in claim 1, wherein the link part comprises:

a first rod member having two end portions, one end portion being fixed to the center portion of the first side of the shutter part, the other end portion having a first hole and being inserted into the first side wall;

a second rod member having two end portions, one end portion being protruded outward the first side wall so as to be in contact with the door when closing and opening the door, the other end portion having a second hole; and a third rod member engaged into the first and second holes so as to rotatably connect the first rod member and the second rod member.

5. The refrigerator as claimed in claim 1, wherein the rod part comprises:

a fourth rod portion having two end portions, one end portion being fixed to the center portion of the second side of the shutter part, the other end portion being movably inserted into a rod-receiving groove part; and a spring seat fixed to the other end portion of the fourth rod portion, and having a diameter larger than that of the fourth rod portion, the spring seat being formed in a disc-shaped fashion.

6. The refrigerator as claimed in claim 1, wherein the rod-receiving groove part comprises:

a rod-receiving groove formed in the second wall;

a groove cover having an insertion opening for inserting the one end portion of the rod part and fixed on the second side wall so as to cover the rod-receiving groove; and a restoring spring inserted into the one end portion of the rod part and positioned between the rod-receiving groove and the groove cover.

7. The refrigerator as claimed in claim 1, wherein the rod-receiving groove part comprises:

a protrusion protruded from the second side wall and having a hollow portion at the center thereof;

a cover having an insertion hole at the center thereof and covering the hollow portion; and a restoring spring inserted in the hollow portion and supporting the rod part.

8. The refrigerator as claimed in claim 1, wherein the shutter part has a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

9. The refrigerator as claimed in claim 1, wherein a porous material is attached on the upper surface of the shutter part.

10. The refrigerator as claimed in claim 9, wherein the porous material is a fibrous material.

11. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod portion having two end portions, one end portion being fixed to the center portion of the first side of the shutter part and the other end portion being movably inserted into the second side wall;

(2) a second rod portion bent at the other end portion of the first rod portion in a certain angle with respect to the first rod portion, and mounted in the first side wall; and (3) a third rod portion bent in a certain angle with respect to the second rod portion so as to be in parallel with the first rod portion, and protruded outward the first side wall so as to be in contact with the door when closing and opening the door;

(b) a rod part moving in the left and right directions according to the left and right directions of the link part, having:

(1) a fourth rod portion having two end portions, one end portion being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a first side wall opposite to the side wall; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part.

12. The refrigerator as claimed in claim 11, wherein the rod-receiving groove part comprises:

a rod-receiving groove formed in the second wall;

a groove cover having a insertion opening for inserting the one end portion of the rod part and fixed on the second side wall so as to cover the rod-receiving groove; and a restoring spring inserted into the one end portion of the rod part and positioned between the rod-receiving groove and the groove cover.

13. The refrigerator as claimed in claim 11, wherein the rod-receiving groove part comprises:

a protrusion protruded from the second side wall and having a hollow portion at the center thereof;

a cover having an insertion hole at the center thereof and covering the hollow portion; and a restoring spring inserted in the hollow portion and supporting the rod part.

14. The refrigerator as claimed in claim 11, wherein the shutter part has a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

15. The refrigerator as claimed in claim 11, wherein a porous material is attached on the upper surface of the shutter part.

16. The refrigerator as claimed in claim 15, wherein the porous material is a fibrous material.

17. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod member having two end portions, one end portion being fixed to the center portion of the first side of the shutter part, the other end portion having a first hole and being inserted into the first side wall;

(2) a second rod member having two end portions, one end portion being protruded outward the first side wall so as to be in contact with the door when closing and opening the door, the other end portion having a second hole; and (3) a third rod member engaged into the first and second holes so as to rotatably connect the first rod member and the second rod member;

(b) a rod part moving in the left and right directions according to the left and right directions of the link part, having:

(1) a fourth rod portion having two end portions, one end portion being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a side wall opposite to the first side wall; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part.

18. The refrigerator as claimed in claim 17, wherein the rod-receiving groove part comprises:

a rod-receiving groove formed in the second wall;

a groove cover having a insertion opening for inserting the one end portion of the rod part and fixed on the second side wall so as to cover the rod-receiving groove; and a restoring spring inserted into the one end portion of the rod part and positioned between the rod-receiving groove and the groove cover.

19. The refrigerator as claimed in claim 17, wherein the rod-receiving groove part comprises:

a protrusion protruded from the second side wall and having a hollow portion at the center thereof;

a cover having an insertion hole at the center thereof and covering the hollow portion; and a restoring spring inserted in the hollow portion and supporting the rod part.

20. The refrigerator as claimed in claim 17, wherein the shutter part has a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

21. The refrigerator as claimed in claim 17, wherein a porous material is attached on the upper surface of the shutter part.

22. The refrigerator as claimed in claim 21, wherein the porous material is a fibrous material.

23. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod portion having two end portions, one end portion being fixed to the center portion of the first side of the shutter part and the other end portion being movably inserted into the first side wall;

(2) a second rod portion bent at the other end portion of the first rod portion in a certain angle with respect to the first rod portion, and mounted in the first side wall; and (3) a third rod portion bent in a certain angle with respect to the second rod portion so as to be in parallel with the first rod portion, and protruded outward the first side wall so as to be in contact with the door when closing and opening the door;

(b) a rod part moving in the left and right directions according to the left and right directions of the link part, having:

(1) a fourth rod portion having two end portions, one end portion being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a side wall opposite to the first side wall, having:

(1) a rod-receiving groove formed in the second wall;

(2) a groove cover having an insertion opening for inserting the one end portion of the rod part and fixed on the second side wall so as to cover the rod-receiving groove; and (3) a restoring spring inserted into the one end portion of the rod part and positioned between the rod-receiving groove and the groove cover; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part, the shutter part having a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

24. The refrigerator as claimed in claim 23, wherein a porous material is attached on the upper surface of the shutter part.

25. The refrigerator as claimed in claim 24, wherein the porous material is a fibrous material.

26. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod portion having two end portions, one end portions being fixed to the center portion of the first side of the shutter part and the other end portion being movably inserted into the second side wall;

(2) a second rod portion bent at the other end portion of the first rod portion in a certain angle with respect to the first rod portion, and mounted in the first side wall; and (3) a third rod portion bent in a certain angle with respect to the second rod portion so as to be in parallel with the first rod portion, and protruded outward the first side wall so as to be in contact with the door when closing and opening the door;

(b) a rod part moving in the left and right directions according to the left and right directions of the link part, having:

(1) a fourth rod portion having two end portions, one end portions being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a side wall opposite to the first side wall, having:

(1) a protrusion protruded from the second side wall and having a hollow portion at the center thereof;

(2) a cover having an insertion hole at the center thereof and covering the hollow portion; and (3) a restoring spring inserted in the hollow portion and supporting the rod part; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part, the shutter part having a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

27. The refrigerator as claimed in claim 26, wherein a porous material is attached on the upper surface of the shutter part.

28. The refrigerator as claimed in claim 27, wherein the porous material is a fibrous material.

29. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod member having two end portions, one end portion being fixed to the center portion of the first side of the shutter part, the other end portion having a first hole and being inserted into the first side wall;

(2) a second rod member having two end portions, one end portion being protruded outward the first side wall so as to be in contact with the door when closing and opening the door, the other end portion having a second hole; and (3) a third rod member engaged into the first and second holes so as to rotatably connecting the first rod member and the second rod member;

(b) a rod part moving in the left and right directions according to the left and right directions of the link part, having:

(1) a fourth rod portion having two end portions, one end portion being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a side wall opposite to the first side wall, having:

(1) a rod-receiving groove formed in the second wall;

(2) a groove cover having an insertion opening for inserting the one end portion of the rod part and fixed on the second side wall so as to cover the rod-receiving groove; and (3) a restoring spring inserted into the one end portion of the rod part and positioned between the rod-receiving groove and the groove cover; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part, the shutter part having a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

30. The refrigerator as claimed in claim 29, wherein a porous material is attached on the upper surface of the shutter part.

31. The refrigerator as claimed in claim 30, wherein the porous material is a fibrous material.

32. A refrigerator with an external air invasion prevention apparatus, comprising:

a return duct having an air inlet portion and formed in a wall separating a freezing room and a refrigerating room, and for providing a passageway to circulate cooled air in the refrigerator;

a duct cover having a plurality of air inlet holes and covering the air inlet portion; and an external air invasion prevention apparatus for closing and opening the plurality of air inlet holes according to opening and closing of a door of the refrigerator, including:

(a) a link part movably engaged with a first side wall on which the door is mounted, and moving in the left and right directions according to the closing and opening of the door, having:

(1) a first rod member having two end portions, one end portion being fixed to the center portion of the one side of the shutter part, the other end portion having a first hole and being inserted into the first side wall;

(2) a second rod member having two end portions, one end portion being protruded outward the first side wall so as to be in contact with the door when closing and opening the door, the other end portion having a second hole; and (3) a third rod member engaged into the first and second holes so as to rotatably connect the first rod member and the second rod member;

(b) a rod part moving in the left and right directions according to the left and right directions of the link part, having:

(1) a fourth rod portion having two end portions, one end portion being fixed to the center portion of the second side of the shutter part, the other end portion being movably inserted into a rod-receiving groove part; and (2) a spring seat fixed to the other end portion of the fourth rod portion, and having a diameter larger than that of the fourth rod portion, the spring seat being formed in a disc-shaped fashion;

(c) a rod-receiving groove part formed on a second side wall and movably receiving one end portion of the rod part, the second side wall being a side wall opposite to the first side wall, having:

(1) a protrusion protruded from the second side wall and having a hollow portion at the center thereof;

(2) a cover having a insertion hole at the center thereof and covering the hollow portion; and (3) a restoring spring inserted in the hollow portion and supporting the rod part; and (d) a shutter part fixed to one end portion of the link part and the other end portion of the rod part so that the shutter part is disposed between the link part and the rod part, and for closing and opening the air inlet portion by moving in the left and right directions according to the movements of the left and right directions of the link part, the center portion of a first side of the shutter part being fixed to the one end portion of the link part and the center portion of a second side of the shutter part being fixed to the other end portion of the rod part, the second side of the shutter part being a side opposite to the first side of the shutter part, the shutter part having a plurality of shutter holes, each of the plurality of shutter holes corresponds with each of the plurality of air inlet holes, the shutter part covering the duct cover so as to open the plurality of air inlet holes when the plurality of shutter holes starts to correspond with the plurality of air inlet holes.

33. The refrigerator as claimed in claim 32, wherein a porous material is attached on the upper surface of the shutter part.

34. The refrigerator as claimed in claim 33, wherein the porous material is a fibrous material.

* * * * *